US006241474B1

(12) United States Patent
Alizadeh et al.

(10) Patent No.: US 6,241,474 B1
(45) Date of Patent: Jun. 5, 2001

(54) AXIAL FLOW FAN

(75) Inventors: Ahmad Alizadeh, Indianapolis, IN (US); Mustapha Belhabib, Montigny le Bretonneux (FR)

(73) Assignee: Valeo Thermique Moteur, La Verriere (FR)

( * ) Notice: Subject to any disclaimer, the term of this patent is extended or adjusted under 35 U.S.C. 154(b) by 0 days.

(21) Appl. No.: 09/223,343

(22) Filed: Dec. 30, 1998

(51) Int. Cl.[7] ..... F04D 29/38

(52) U.S. Cl. ..... 416/189; 416/223 R; 416/DIG. 2; 416/DIG. 5

(58) Field of Search ..... 416/169 A, 189, 416/192, 223 R, 238, 243, DIG. 2, DIG. 5

(56) References Cited

U.S. PATENT DOCUMENTS 4,684,324 * 8/1987 Perosino ..... 416/189
5,273,400 * 12/1993 Amr ..... 416/189
5,326,225 * 7/1994 Gallivan et al. ..... 416/179
5,624,234 * 4/1997 Neely et al. ..... 416/238
5,769,607 * 6/1998 Neely et al. ..... 416/189
5,961,289 * 10/1999 Lohmann ..... 416/189

FOREIGN PATENT DOCUMENTS

177047 * 3/1922 (GB) ..... 416/192

* cited by examiner

*Primary Examiner*—Edward K. Look
*Assistant Examiner*—James M McAleenan
(74) *Attorney, Agent, or Firm*—Morgan & Finnegan LLP

(57) ABSTRACT

An axial flow fan has a hub and plural blades. Each blade extends from hub to a blade support ring and has a pitch which decreases over a first inner part of the radial extent and increases over a second outer part of the radial extent.

In a preferred embodiment, the trailing edge of the blade tip and the median point of the blade root are situated on a common radial line. In a further preferred embodiment, a median point on the tip chord of the blade is disposed angularly ahead of a median point of the root chord.

The fan provides improved noise performance.

23 Claims, 7 Drawing Sheets

AXIAL FLOW FAN

FIELD OF THE INVENTION

The present invention relates generally to an axial flow fan, and more specifically but not exclusively to such a fan for use as a generator of air flow through a heat exchanger.

DISCUSSION OF PRIOR ART

Axial flow fans are widely used to move air, especially in such applications as cooling systems, and in particular for cooling systems for motor vehicles.

In motor vehicle cooling applications, such fans are commonly powered by electric motors, although belt drive and other drive systems are also used. In identifying components which detract from low power consumption, it has been noted that state of the art fans tend to be wasteful of energy, thus necessitating relatively powerful drive motors. Waste of energy normally manifests itself as high noise, and in view of the many successful measures taken to reduce the general level of noise both within and outside of the vehicle, state of the art fans have been identified as a substantial source of noise. To provide adequate performance, state of the art fans may be over-dimensioned and thus heavier than required.

It is thus an object of the present invention to provide an axial flow fan which at least partly mitigates the problems of the prior art.

SUMMARY OF THE INVENTION

According to one aspect of the invention there is provided an axial flow fan having a hub portion, a plurality of blades and a blade tip support portion, each blade extending from the hub portion to the blade tip support portion, wherein each blade has a pitch which decreases over a first inner part of the radial extent of the blade and increases over a second outer part of the radial extent of the blade.

Preferably each blade has a root portion and a tip portion, and said first inner part extends to between 40% and 60% of the blade extent, and the second part extends from said first part to the blade tip portion.

Advantageously said first part extends to substantially 50% of the blade extent.

Conveniently each blade has a leading edge, whereby a radial line passing through the root of said blade at said leading edge also passes through the tip of said blade at the leading edge.

Advantageously for each blade, the trailing edge at the blade tip and the median point of the blade root are situated on a common radial line.

Conveniently the fan has a root portion and a tip portion, said root portion having a root chord and said tip portion having a tip chord, wherein a median point of said tip chord is disposed angularly ahead with respect to the direction of rotation of a median point of said root chord.

Preferably each blade has a camber defined by the maximum deviation of a medial line through a blade cross-section from the corresponding chord, said camber being no more than 8% of the length of said corresponding chord.

Conveniently the ratio of maximum blade thickness to the chord length of each blade is less than or equal to 1:10.

According to a second aspect of the invention there is provided an axial flow fan having a hub portion, a plurality of blades, each blade having a root, a tip, a leading edge and a trailing edge, the root being secured to said hub portion, wherein for each blade, the trailing edge at the blade tip and the median point of the blade root are situated on a common radial line.

According to a third aspect of the invention there is provided an axial flow fan having a hub portion, a plurality of blades, each blade comprising a root portion having a root chord, a tip portion having a tip chord, a leading edge and a trailing edge, the root being secured to said hub portion, wherein a median point of said tip chord is disposed angularly ahead with respect to the direction of rotation of a median point of said root chord.

Advantageously the angle subtended at the centre of rotation by said tip chord median point and said root chord median is less than or equal to 360°/(4n+k), where n is the number of blades and k is a correction value which depends on the number of blades.

Advantageously the angle subtended at the centre of rotation by said tip chord median point and said root chord median is greater than or equal to 360°/(16n+k) where n is the number of blades and k is a correction value which depends on the number of blades.

Conveniently each blade has a camber defined by the maximum deviation of a medial line through a blade cross-section from the corresponding chord, said camber being no more than 8% of the length of said corresponding chord.

Advantageously the ratio of the maximum blade thickness to the chord length of each blade is less than or equal to 1:10.

According to a fourth aspect of the invention there is provided an axial flow fan having a hub portion and a plurality of blades, each blade comprising a root portion having a root chord and each blade having a leading edge extending from the root portion to a blade tip, wherein a median point of each blade root chord is disposed angularly behind with respect to the direction of rotation of said tip of the leading edge of the blade.

Advantageously the angle subtended at the centre of rotation of said fan by said median point and said tip of said leading edge is less than or equal to 360°/(2n+k) where n is the number of blades and k in a value which depends on the number of blades.

Advantageously the angle subtended at the centre of rotation of said fan by said median point and said blade tip is greater than or equal to 360°/(8n+k), where n is the number of blades and k is a value which depends on the number of blades.

Conveniently each blade has a camber defined by the maximum deviation of a medial line through a blade cross section from the corresponding chord, said camber being no more than 8% of the length of said corresponding chord.

According to a fifth aspect of the invention there is provided an axial flow fan having a plurality of blades, each blade having a camber defined by the maximum deviation of a medial line through a blade cross-section from the corresponding chord, said camber being no more than 8% of the length of said corresponding chord.

Preferably the ratio of the camber to the chord length of each blade increases along the radially inner half of the blade and decreases along the radially outer half of the blade.

According to a sixth aspect of the invention there is provided an axial flow fan having a plurality of blades wherein the ratio of the maximum blade thickness to the chord length of each blade is less than or equal to 1:10.

Preferably the ratio of the maximum blade thickness to the chord length of each blade substantially decreases along the substantially first half of the radial extent and substantially increases along the substantially second half of the radial extent.

BRIEF DESCRIPTION OF THE DRAWINGS

A preferred embodiment of the invention will now be described with reference to the accompanying drawings in which.

DESCRIPTION OF THE PREFERRED EMBODIMENTS

In the various figures like reference signs refer to like parts. Also in the following description the term "forwards" is used to signify the direction of the sense of rotation and "backwards" is used to signify opposite to the sense of rotation.

Figure 1:
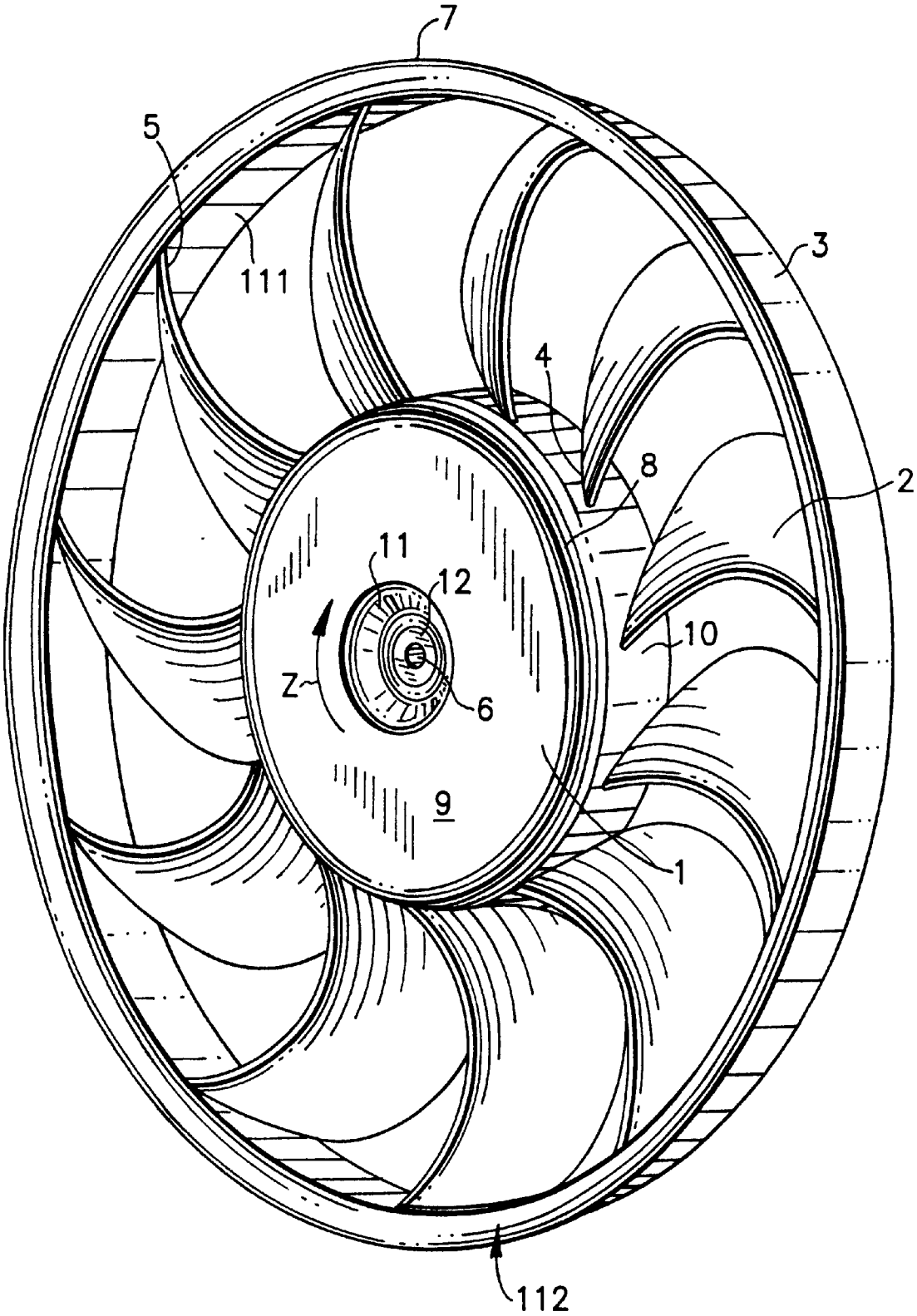
FIG. 1 shows an overall perspective view of a fan in accordance with the invention.

Referring to FIG. 1, an axial fan for rotation about a centre of rotation (6) has a hub portion (1), a plurality of blades (2) here 11 in number, and a blade tip support (3) hereinafter referred to as a ring. The blades are secured to the hub portion at their roots (4) and they extend radially outwards to a tip region (5) where they are secured to the ring (3). The fan is adapted to rotate in a clockwise direction as shown by the arrow Z in the view shown in FIG. 1.

The hub portion (1) has a substantially cylindrical side wall (10), having a convex curved surface (8) between a planar front face (9) and the side wall (10). The planar front face (9) is orthogonal to the axis of rotation. A recessed central area consists of a second convex curved surface (11) extending from the front face (9) to a recessed planar surface (12). The planar surface (12) has an axial hole concentric with the centre of rotation (6) of the fan. The hole is defined by a cylindrical wall which is adapted in use to engage a drive shaft for rotation thereby of the fan.

The entirety of the root of each blade is secured to the side wall of the hub portion (10). The fan blades are disposed equidistant around the hub portion. The blade roots (4) have chords disposed at an angle to the front face of the hub portion (10), to define the root pitch angle. Each blade curves radially outwards from its root (4) towards the ring (3) in such a manner that the pitch angle defined by the angle between a respective blade chord and the plane of the front face varies along the length of the blade. Also, the thickness of the blade and the width of the blade vary along the radial length of the blade. Each blade is secured to the ring (3) along the entirety of its tip (5), this distance constituting the width of the blade at the tip.

Figure 2:
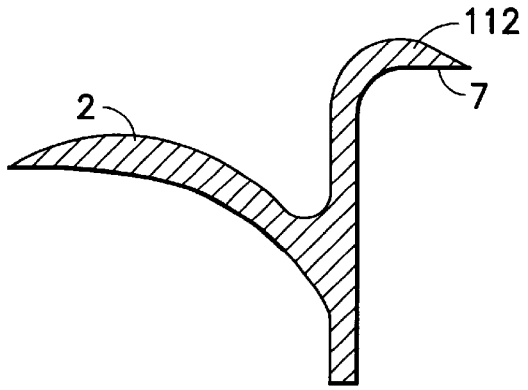
FIG. 2 shows a cross-section of the blade tip support ring of the fan of FIG. 1.

The ring (3) has a first annular cylindrical wall portion defining an inner and an outer cylindrical surface, whose axial extent corresponds to the axial extent of the blades at their tip region. The blade tips are attached to the inner surface (111) of the sides of the cylindrical portion. A second curved lip portion (112) of the ring extends about the cylindrical portion radially outwards and convex towards the front of the fan as viewed. The second curved lip portion 112 is tapered at its outer extent (7), that is to say, the material thickness decreases. This detail can be seen more clearly as a cross-sectional view in FIG. 2. The ring is useful for providing extra strength to the blades and in co-operation with a suitable shroud to maintain the airflow in the axial direction by reducing tip vortices, as is known in the art.

Figure 3:
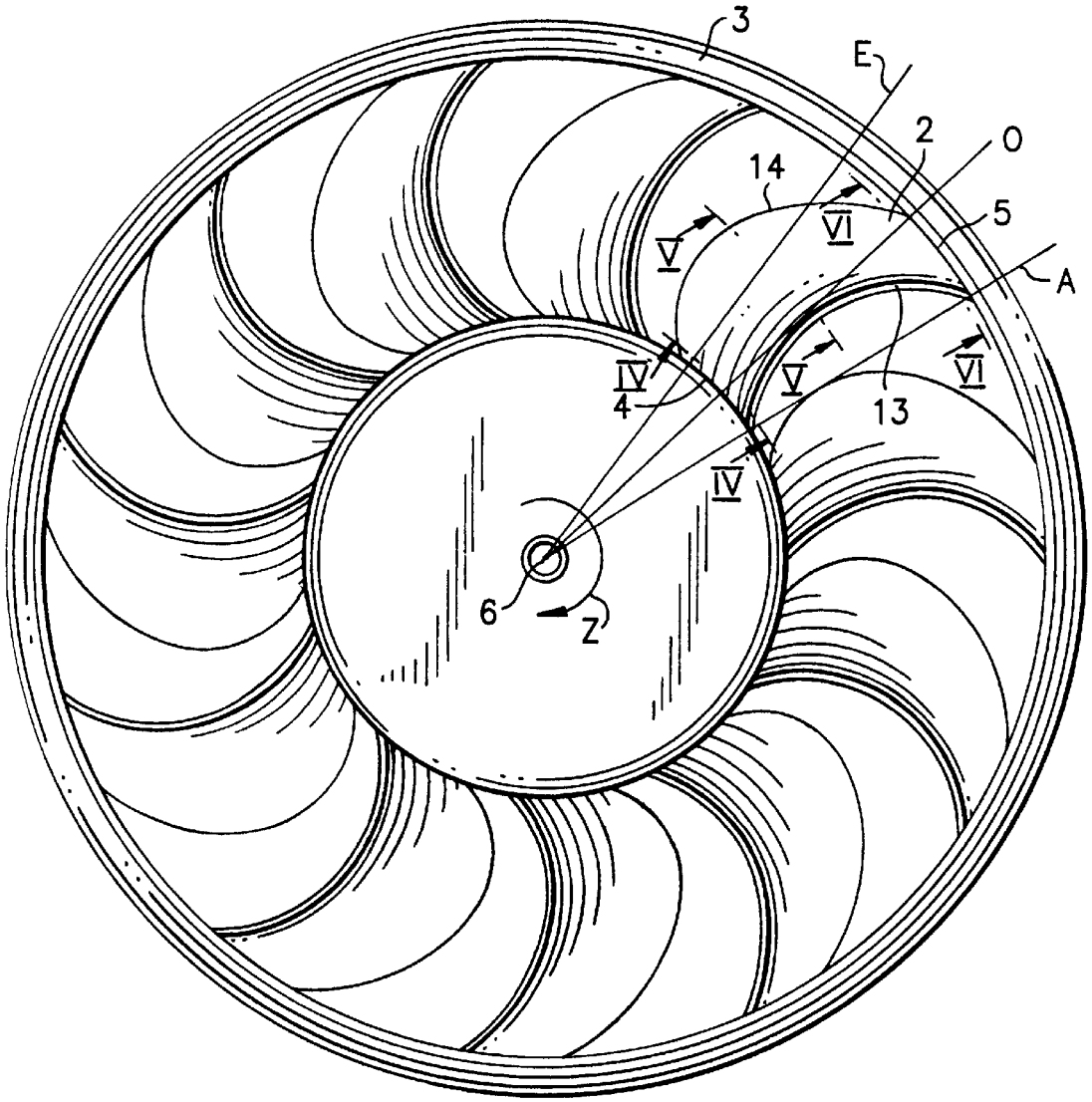
FIG. 3 shown a projection onto a plane orthogonal to the axis of rotation of the fan of FIG. 1.

Referring now to FIG. 3, the projection of each blade curves from its root first backwards over substantially 50% of its radial extent and then forwards over the remaining substantially 50% of its radial extent. Both the leading edge (13) and the trailing edge (14) of each blade (2) curve in a mutually generally similar fashion, the curves being concave when viewed with respect to the direction of rotation. The curvature of the trailing edge (14) is greater than that of the leading edge (13).

Continuing to refer to FIG. 3 it can be seen that the fan has a forward skewed trailing edge (14), in that a first radial line O passing through the blade tip at the trailing edge (14) is disposed forwards of a second radial line E which passes through the blade root at the trailing edge. By contrast, the leading edge (13) is unskewed; thus a third radial line A passes through both the tip and the root at this edge.

As previously noted, the blade has a pitch which varies along the radial extent, and this will now be described, with respect to FIGS. 4–6.

Figure 4:
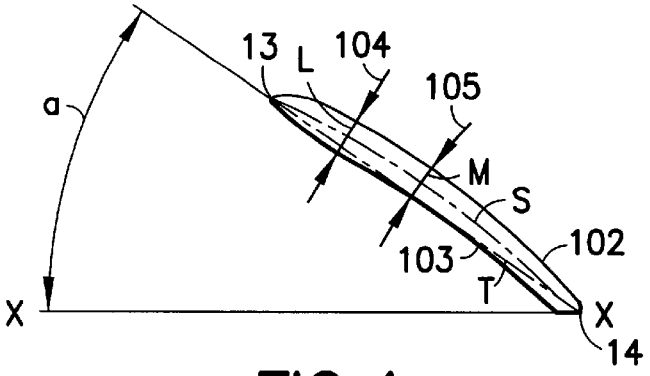
FIG. 4 shows the pitch angle of the blade of the fan of FIG. 1 along line IV–IV' on FIG. 3.

FIG. 4 shows the blade cross-section at the root portion, taken along line IV–IV' where it is attached to the hub. The blade has a chord formed by the straight line T between the leading edge (13) and the trailing edge (14). The angle a between the blade chord at its root and a plane X—X orthogonal to the axis of rotation is the root pitch angle. The figure also shows a cross-sectional medial line S which is equidistant the upper surface (102) and the lower surface (103) of the blade. It will be seen that the blade cross section is generally concave-convex, with the upper surface (102) being convex and the lower surface (103) being concave: this general form of blade continues along its entire radial length. As seen, the blade has a maximum thickness L at a point (104) approximately a quarter of the way from the leading edge to the trailing edge, the thickness being defined as the distance between the two surfaces of the blade in a direction perpendicular to the chord. The blade has a camber M which is the maximum distance between the chord T and the medial line S, at a point (10S) about half way between the leading and trailing edges.

Figure 5:
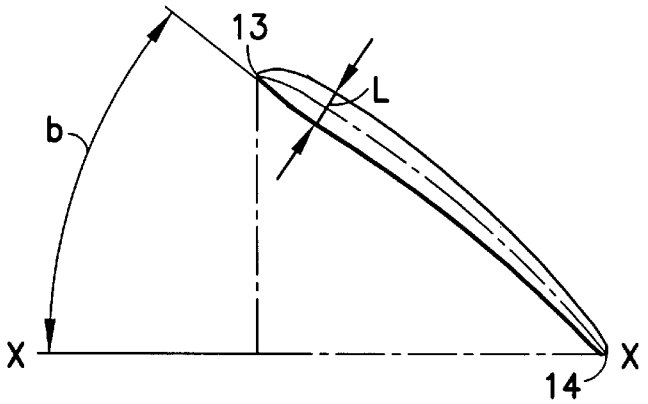
FIG. 5 shows the pitch angle of the blade of the fan of FIG. 1 along line V–V' on FIG. 3.
Figure 6:
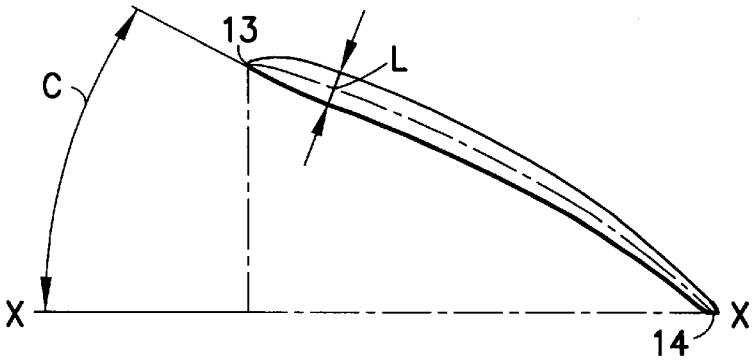
FIG. 6 shows the pitch angle of the blade of the fan of FIG. 1 along line VI–VI' on FIG. 3.

FIG. 5 shows the blade cross-section at line V–V' halfway along the radial extent of the blade, with similar chord and medial lines to FIG. 4. The angle b is the corresponding pitch angle. The maximum thickness L is closer to the leading edge (13) than in FIG. 4, being around one sixth of the way along the chord. FIG. 6 shows the blade cross-section at line VI–VI' where it is attached to the blade tip support, the angle c being the tip pitch angle. The maximum thickness point L is yet closer to the leading edge (13), being around one eighth of the way from the leading edge.

In the described embodiment, the halfway point along the blade radius is the point of minimum pitch angle, and thus angle b is less than the root pitch angle a. The tip pitch angle is greater than the minimum pitch angle b and in the described embodiment is slightly greater than root pitch angle a. A typical variation between minimum and maximum pitch angle along the blade is 10°.

Figure 7:
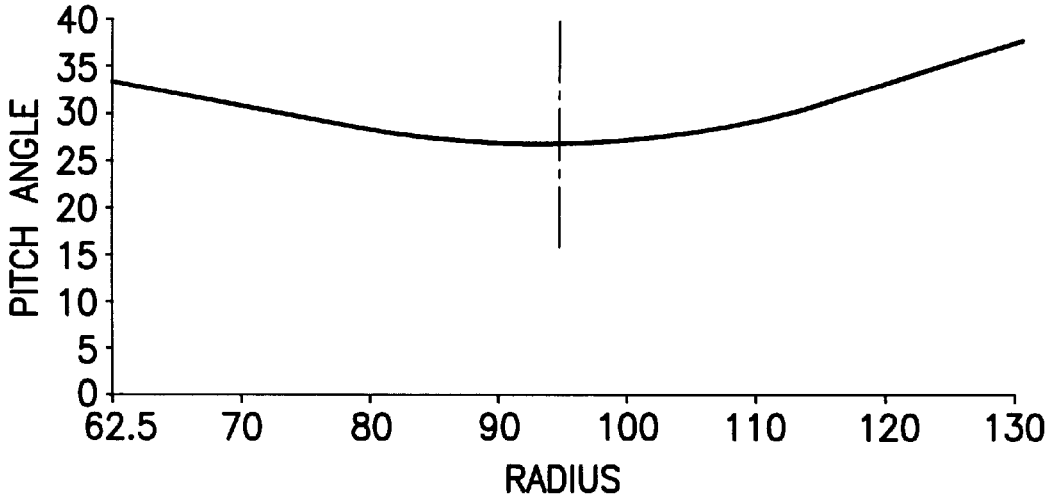
FIG. 7 shows graphically the variation of pitch angle along the radial extent of the blade.

In FIG. 7 the pitch variation along the length of a blade can be seen as a graphical representation. As noted, in the described embodiment the radial position of minimum pitch angle is halfway between the root and the tip support ring. Thus:

$$R_m=0.5(R_f+R_i)$$

where $R_m$ is the radius of minimum pitch, $R_f$ is the root radius and $R_i$ is the tip radius.

However, this particular relationship is only a feature of the embodiment, and other arrangements are envisaged.

The fan of the preferred embodiment has a high efficiency, which enables the low diameter of 260 mm. The provision of a blade having a pitch which decreases over a first inner part of the radial extent of the blade and increases over a second outer part of the radial extent of the blade could be applied to fans of different sizes and different numbers of blades.

Figure 8A:
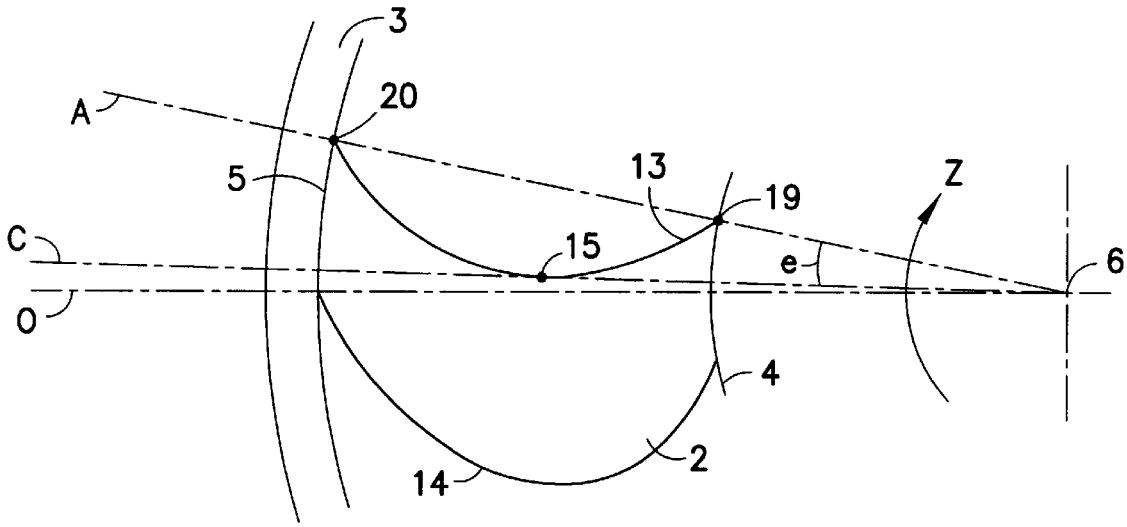
FIGS. 8A and 8B depict a blade profile and the relevant angles subtended at the centre of rotation.

FIG. 8A shows a projection of a blade 2 and includes the previously described third radial line A passing through the leading edge at both the root (19) and the tip (20). The figure also shows first radial line O which passes through both tip and root of the trailing edge. Continuing to refer to FIG. 8A, the leading edge (13) of the fan is tangential to a fourth radial line C. The tangent point (15) is encountered within the first 30% of the radial extent of the blade. Furthermore, the fourth radial line C is situated forwards of first radial line O.

For good blade strength, it is desirable that fourth radial line C either coincides with or is situated forwards in the direction of rotation of first radial line O, because this allows there to be a portion of blade on a radial line which passes through the centre of rotation, or between two radial lines which pass through the centre of rotation, along an entire radial extent of the blade.

Figure 8B:
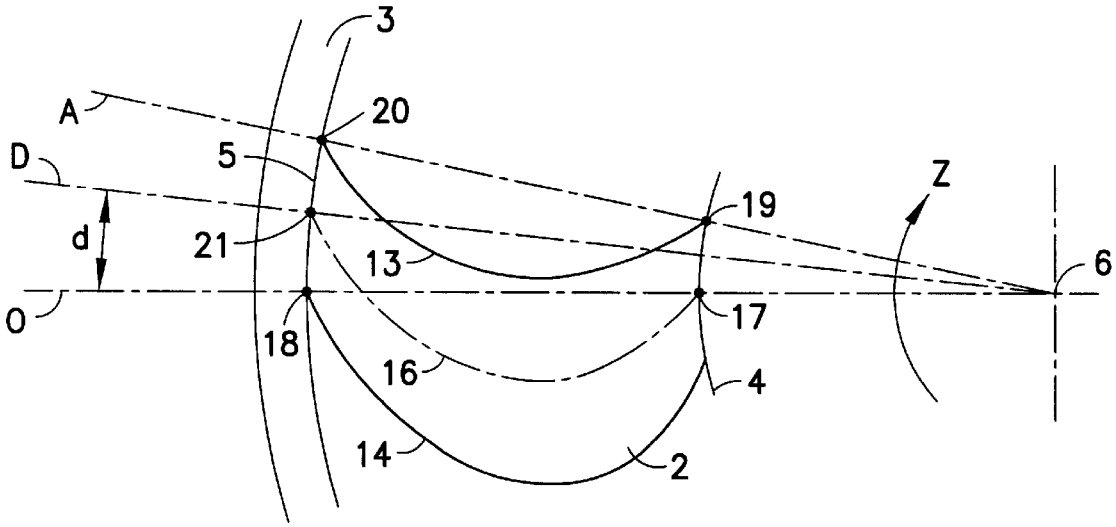

FIG. 8B shows a similar view of blade 2 as FIG. 8A but includes a depiction of the median line 16. In the described embodiment, the first radial line O which intersects the tip (18) of the blade at its trailing edge (14) also passes through the median point of the blade root (17). A fifth radial line D, which passes through the median point of the tip (21) of the blade is situated forwards of first radial line O and subtends at the centre of rotation an angle d which is defined by:

$$\frac{360°}{4n+k} \geq \text{angle } d \geq \frac{360°}{16n+k}$$

where n is the number of blades and k is a variable correction which depends on the number of blades, its purpose being to make the limits on angle d whole numbers.

As previously mentioned, this described embodiment has 11 blades and the correction factors are 1 and 4 respectively, hence $$2° \leqq \text{angle } d \leqq 80°$$

Another feature of the described embodiment shown in FIG. 8A, is that the third radial line A passes through the tip and root of the fan at the leading edge and that the leading edge subtends at the centre of rotation an angle, angle e, which lies between the following limits:

$$\frac{360°}{2n+k} \geq \text{angle } e \geq \frac{360°}{8n+k}$$

where n is the number of blades and k is a variable correction factor as before.

With 11 blades, the correction factor is 2 for both limits, hence $$4° \leqq \text{angle } d \leqq 15°$$

Figure 9:
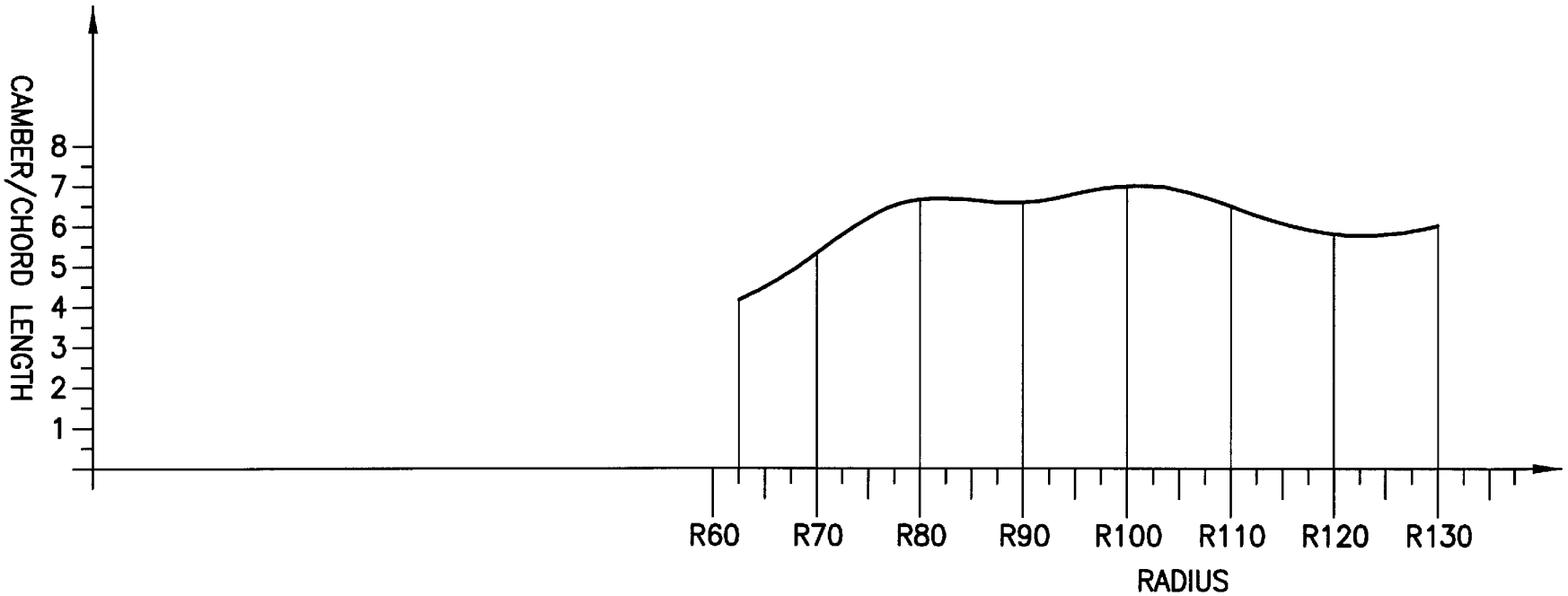
FIG. 9 shows the variation in the radial direction of the relation of camber to the chord length.

Referring now to FIG. 9, showing the relation of camber/chord length with blade radius, it will be seen that camber: chord length increases along the inner half of the blade and then decreases along the outer half, although not exceeding 2:23.

Figure 10:
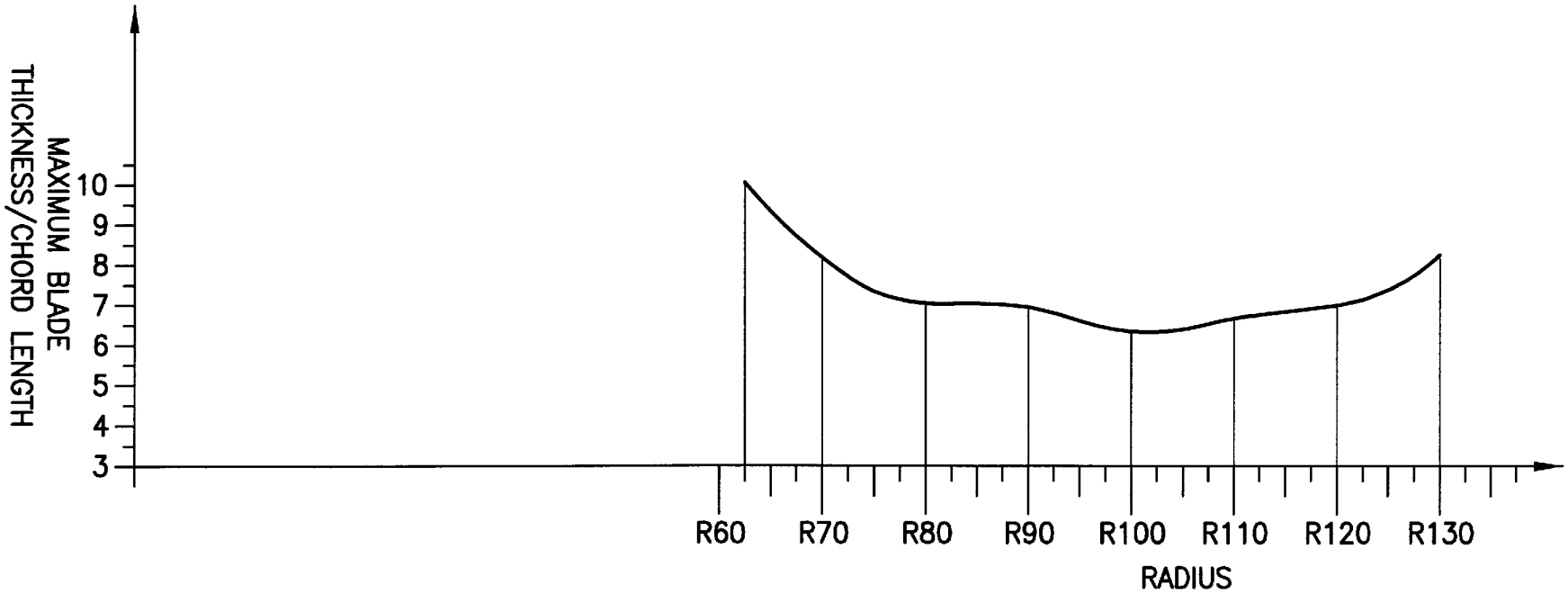
FIG. 10 shows the variation in the radial direction of the relation of the blade thickness to the chord length.

Turning to FIG. 10, showing the ratio of maximum blade thickness to chord length with blade radius, it will be seen that this ratio decreases along the inner half of the blade and increases along the outer half while not exceeding 1:10.

A preferred embodiment of the invention has been described, but it will be is understood that the invention is not limited to features thereof, nor to similar designs of fan except in so far as specified by features recited in the appended claims, or their equivalents. It will be clear to one skilled in the art that no ring is necessary to the invention, and that where a ring is provided, the fan blades may continue past the ring. Furthermore, the particular skew of the blades, the pitch angles, and other parameters specified herein, including the number of blades may be chosen for the application for which the fan is intended. Although a fan has been described in the context of use for a vehicle cooling system, other applications are possible.

What is claimed is:

1. An axial flow fan having a hub portion, a plurality of blades and a blade tip support portion, each blade extending from the hub portion to the blade tip support portion, each blade having a pitch which has a lowest value at substantially a halfway point of a radial extent of the blade and which increases along the radial extent from substantially the halfway point to both the hub portion and the blade tip support portion.

2. The fan of claim 1, wherein each blade has a root portion and a tip portion, and said first inner part extends to between 40% and 60% of the blade extent, and the second part extends from said first part to the blade tip portion.

3. The fan of claim 1, wherein said first part extends to substantially 50% of the blade extent.

4. The fan of claim 1, wherein each blade has a leading edge, whereby a radial line passing through the root of said blade at said leading edge also passes through the tip of said blade at the leading edge.

5. The fan of claim 1 wherein each blade has a leading edge and wherein an angle swept at the fan centre by the leading edge is equal to or less than 360°/(2n+k) and equal to or greater than 360°/(8n+K) where n is the number of blades, k is a first correction factor which depends on the number of blades and K is a second correction factor which depends on the number of blades.

6. The fan of claim 1 wherein for each blade, the trailing edge at the blade tip and the median point of the blade root are situated on a common radial line.

7. The fan of claim 1 having a root portion and a tip portion, said root portion having a root chord and said tip portion having a tip chord, wherein a median point of said tip chord is disposed angularly ahead with respect to the direction of rotation of a median point of said root chord.

8. The fan of claim 1 wherein each blade has a camber defined by the maximum deviation of a medial line through a blade cross-section from the corresponding chord, said camber being no more than 8% of the length of said corresponding chord.

9. The fan of claim 1 wherein the ratio of maximum blade thickness to the chord length of each blade is less than or equal to 1:10.

10. An axial flow fan having a hub portion, a plurality of blades and a blade tip support portion, each blade having a root, a tip, a leading edge and a trailing edge, the root being secured to said hub portion and the tip being secured to the blade tip support portion, wherein for each blade, the trailing edge at the blade tip and the median point of the blade root are situated on a common radial line, each blade further having a pitch which has a lowest value at substantially a halfway point of an extent of the blade and which increases along the extent from substantially the halfway point to both the hub portion and the blade tip support portion.

11. An axial flow fan having a hub portion, a plurality of blades and a blade tip support portion, each blade comprising a root portion having a root chord, a tip portion having a tip chord, a leading edge and a trailing edge, the root being secured to said hub portion and the tip being secured to the blade tip support portion, wherein a median point of said tip chord is disposed angularly ahead with respect to the direction of rotation of a median point of said root chord, each blade further having a pitch which has a lowest value at substantially a halfway point of an extent of the blade and which increases along the extent from substantially the halfway point to both the hub portion and the blade tip support portion.

12. The fan of claim 11, wherein the angle subtended at the centre of rotation by said tip chord median point and said root chord median is less than or equal to 360°/(4n+k), where n is the number of blades and k is a correction value which depends on the number of blades.

13. The fan of claim 11, wherein the angle subtended at the centre of rotation by said tip chord median point and said root chord median is greater than or equal to 360°/(16n+k), where n is the number of blades and k is a correction value which depends on the number of blades.

14. The fan of claim 11 wherein each blade has a camber defined by the maximum deviation of a medial line through a blade cross-section from the corresponding chord, said camber being no more than 8% of the length of said corresponding chord.

15. The fan of claim 14, wherein the ratio of the maximum blade thickness to the chord length of each blade is less than or equal to 1:10.

16. An axial flow fan having a hub portion and a plurality of blades, each blade comprising a root portion having a root chord and each blade having a leading edge extending from the root portion to a blade tip, wherein a median point of each blade root chord is disposed angularly behind with respect to the direction of rotation of said tip of the leading edge of the blade, each blade further having a pitch which has a lowest value at substantially a halfway point of an extent of the blade and which increases along the extent from substantially the halfway point to both the hub portion and the blade tip support portion.

17. The fan of claim 16, wherein the angle subtended at the centre of rotation of said fan by said root median point and the blade tip leading edge is less than or equal to 360°/(2n+k) where n is the number of blades and k is a correction value which depends on the number of blades.

18. The fan of claim 16, wherein the angle subtended at the centre of rotation of said fan by a medial line at the tip and said medial line at the root is less than or equal to 360°/(4n+k), where n is the number of blades and k is a correction value which depends on the number of blades.

19. The fan of claim 16, wherein each blade has a camber defined by the maximum deviation of a medial line through a blade cross-section from the corresponding chord, said camber being no more than 8% of the length of said corresponding chord.

20. An axial flow fan having a plurality of blades, each blade having a camber defined by the maximum deviation of a medial line through a blade cross-section from the corresponding chord, said camber being no more than 8% of the length of said corresponding chord, each blade further having a pitch which has a lowest value at substantially a halfway point of an extent of the blade and which increases along the extent from substantially the halfway point to both the hub portion and the blade tip support portion.

21. The fan of claim 20, wherein the ratio of the camber to the chord length of each blade increases along the radially inner half of the blade and decreases along the outer of the blade.

22. An axial flow fan having a plurality of blades wherein the ratio of the maximum blade thickness to the chord length of each blade is less than or equal to 1:10, each blade further having a pitch which has a lowest value at substantially a halfway point of an extent of the blade and which increases along the extent from substantially the halfway point to both a hub portion and a blade tip support portion.

23. The fan of claim 22, wherein the ratio of the maximum blade thickness to the chord length of each blade substantially decreases along the substantially first half of the radial extent and substantially increases along the substantially second half of the radial extent.

* * * * *